US012385247B2

(12) United States Patent
Brekke

(10) Patent No.: US 12,385,247 B2
(45) Date of Patent: Aug. 12, 2025

(54) GIRDER TIE

(71) Applicant: Columbia Insurance Company, Omaha, NE (US)

(72) Inventor: Steven Brekke, Lakeville, MN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 18/469,341

(22) Filed: Sep. 18, 2023

(65) Prior Publication Data

US 2024/0003131 A1 Jan. 4, 2024

Related U.S. Application Data

(62) Division of application No. 17/128,264, filed on Dec. 21, 2020, now Pat. No. 11,821,199.

(60) Provisional application No. 62/950,455, filed on Dec. 19, 2019.

(51) Int. Cl.
*E04B 1/38* (2006.01)
*E04H 9/14* (2006.01)

(52) U.S. Cl.
CPC ..... *E04B 1/388* (2023.08); *E04H 9/14* (2013.01); *E04B 2001/389* (2023.08)

(58) Field of Classification Search
CPC ..... E04B 1/388; E04B 2001/389; E04H 9/14
See application file for complete search history.

(56) References Cited

U.S. PATENT DOCUMENTS 4,183,305 A * 1/1980 Payne ..... C21D 9/70 432/250
4,665,672 A * 5/1987 Commins ..... F16B 9/058 52/702
6,112,495 A 9/2000 Gregg et al.
6,513,290 B2 * 2/2003 Leek ..... E04B 1/2604 52/297
6,550,200 B1 4/2003 Mueller
6,715,258 B1 4/2004 Mueller
7,707,785 B2 5/2010 Lin
7,971,411 B2 * 7/2011 Commins ..... E04B 1/2604 52/293.3
8,234,826 B1 8/2012 Proffitt, Jr.
(Continued)

OTHER PUBLICATIONS

Simpson Strong-Tie Company, Inc., Simpson Strong-Tie Wood Construction Connectors VGT Catalog Page (003), Girder Tiedowns, pp. 278-279, 2019.

*Primary Examiner* — Basil S Katcheves
(74) *Attorney, Agent, or Firm* — Stinson LLP

(57) ABSTRACT

A girder tie for connecting a building component to a rigid rod to resist uplift forces applied to the building component comprises a connector including a building component connector and a rigid rod connector coupled to the building component connector. The rigid rod connector attaches to the rigid rod. The building component connector includes first and second back flanges free of direct connection to one another. The first and second back flanges can each be attached to the building component. A washer is disposed between the rigid rod connector and a nut on the rigid rod that secures the rigid rod to the girder tie. The washer includes at least one back flange brace to inhibit the first and second back flanges from moving relative to one another when the building component experiences the uplift forces.

13 Claims, 9 Drawing Sheets

(56) References Cited

U.S. PATENT DOCUMENTS

| | | | | |
|---|---|---|---|---|
| 8,387,321 | B2 * | 3/2013 | diGirolamo | E04B 2/58 52/713 |
| 8,555,580 | B2 * | 10/2013 | Vilasineekul | E04B 1/2604 52/696 |
| 8,769,887 | B2 | 7/2014 | Proffitt, Jr. | |
| 8,844,229 | B1 | 9/2014 | Hohmann, Jr. | |
| 9,297,161 | B2 | 3/2016 | Zimmerman et al. | |
| 10,179,992 | B2 | 1/2019 | Brekke | |
| 10,415,614 | B2 * | 9/2019 | Belinda | F16B 5/02 |
| 10,480,177 | B2 | 11/2019 | Siddhartha et al. | |
| 2002/0066247 | A1 * | 6/2002 | Leek | E04B 1/2604 52/297 |
| 2003/0213194 | A1 * | 11/2003 | Kawai | E04C 3/07 52/261 |
| 2006/0213136 | A1 | 9/2006 | Lin | |
| 2008/0098669 | A1 * | 5/2008 | Lin | E04B 7/045 52/92.2 |
| 2009/0107082 | A1 * | 4/2009 | Commins | E04H 9/14 52/745.12 |
| 2009/0113839 | A1 | 5/2009 | Carr | |
| 2015/0184370 | A1 | 7/2015 | Brekke et al. | |
| 2015/0218832 | A1 | 8/2015 | Peters et al. | |

* cited by examiner

GIRDER TIE

CROSS-REFERENCE TO RELATED APPLICATIONS

This application is a divisional of U.S. patent application Ser. No. 17/128,264 filed Dec. 21, 2020, titled Girder Tie, which application claims priority to U.S. Provisional Application No. 62/950,455, filed Dec. 19, 2019, the entireties of which are incorporated by reference.

FIELD

The present disclosure generally relates to girder ties used to resist uplift loads in buildings and other structures.

BACKGROUND

Girder ties are used to resist uplift loads of building components, such as joists, beams, trusses, etc. Girder ties are commonly used in buildings located in high wind areas (e.g., hurricane or tornado areas) to resist the uplift forces applied to building components by winds blowing into, over, and/or around the building. One conventional type of girder tie connects the building component to a rigid rod that is anchored to a part of the building such as a foundation or a wall. When an uplift force is applied to the building component, the connection between the rigid rod and the girder tie resists the uplift force, holding the building component in position.

SUMMARY

In one aspect, a girder tie for connecting a building component to a rigid rod to resist uplift forces applied to the building component comprises a connector. The connector includes a building component connector and a rigid rod connector coupled to the building component connector. The rigid rod connector is configured to attach to the rigid rod. The building component connector includes first and second back flanges free of direct connection to one another. The first and second back flanges are each configured to attach to the building component. A washer is configured to be disposed between the rigid rod connector and a nut on the rigid rod that secures the rigid rod to the girder tie. The washer includes at least one back flange brace configured to inhibit the first and second back flanges from moving relative to one another when the building component experiences the uplift forces.

In another aspect, a girder tie for connecting a building component to a rigid rod to resist uplift forces applied to the building component comprises a connector. The connector includes a building component connector configured to attach to the building component and a rigid rod connector coupled to the building component connector. The rigid rod connector is configured to attach to the rigid rod. The rigid rod connector is configured to form a moment couple with the rigid rod to resist the uplift forces applied to the building component when the building component experiences the uplift forces. A nut is configured to be threaded onto the rigid rod to secure the rigid rod to the girder tie.

Other objects and features of the present disclosure will be in part apparent and in part pointed out hereinafter.

BRIEF DESCRIPTION OF THE DRAWINGS

Corresponding reference characters indicated corresponding parts throughout the drawings.

DETAILED DESCRIPTION OF THE DISCLOSURE

Figure 1:
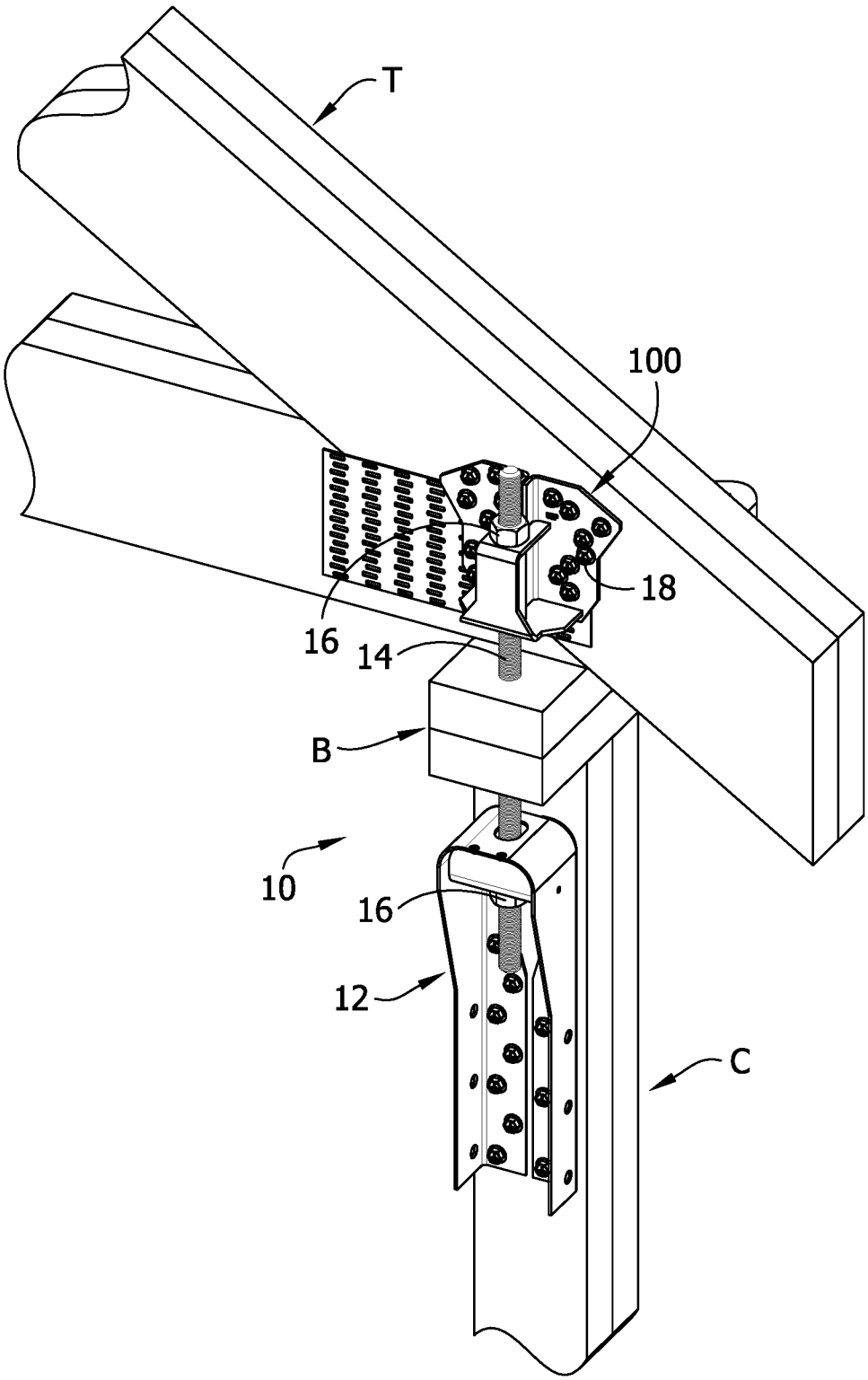
FIG. 1 is a perspective of a fragmentary portion of a building showing a girder tiedown assembly according to one embodiment of the present disclosure tying a roof truss of the building to a column or stud(s) of the building.

Referring to FIG. 1, one embodiment of a girder tiedown assembly constructed according to the teachings of the present disclosure is indicated generally at reference numeral 10. As shown in FIG. 1, the girder tiedown assembly 10 is used to tie or anchor one building component to a supporting member in order to resist any uplift forces that are applied to the building component. In the illustrated embodiment, the girder tiedown assembly 10 is used to tie a roof truss T (e.g., building component) to a stud(s) C of a wall (e.g., supporting member) of the building to counteract any uplift forces that may lift the roof truss generally upward and away from the stud(s). However, it is understood that the girder tiedown assembly 10 can be used to tie generally any type of building component down such as a joist, a beam, another type of truss, a column, etc. It is also understood that the girder tiedown assembly 10 can be used to tie a building component T to support members besides studs C such as columns and concrete walls (e.g., foundation walls).

The girder tiedown assembly 10 includes a holdown or anchor 12, a rigid rod 14 and a girder tie 100. The holdown 12 is secured to the stud C and the girder tie 100 is secured to the truss T (broadly, building component), with the rigid rod 14 interconnecting the holdown and girder tie to prevent the truss from being lifted relative to the wall. One example of a suitable holdown is the PHD/DTB Holdowns available from MiTek USA, Inc., St. Louis, Missouri. Nuts 16 are used to secure the rigid rod to the holdown 12 and girder tie 100—i.e., the rigid rod is at least partially threaded. The girder tie 100 connects the truss T to the rigid rod 14 to resist the uplift forces applied to the truss. In the illustrated embodiment, the girder tiedown assembly 10 is used with wood frame construction with the rigid rod 14 extending through a top plate B of the wall to interconnect the holdown 12 and the girder tie 100. The girder tiedown assembly 10 can be used with other types of construction. For example, the girder tiedown assembly 10 can be used to tie the truss T a concrete wall (e.g., supporting member). In that embodiment, the girder tiedown assembly 10 may not include the holdown 12. Instead, the rigid rod 14 can be embedded in the concrete wall (not shown).

Figure 2:
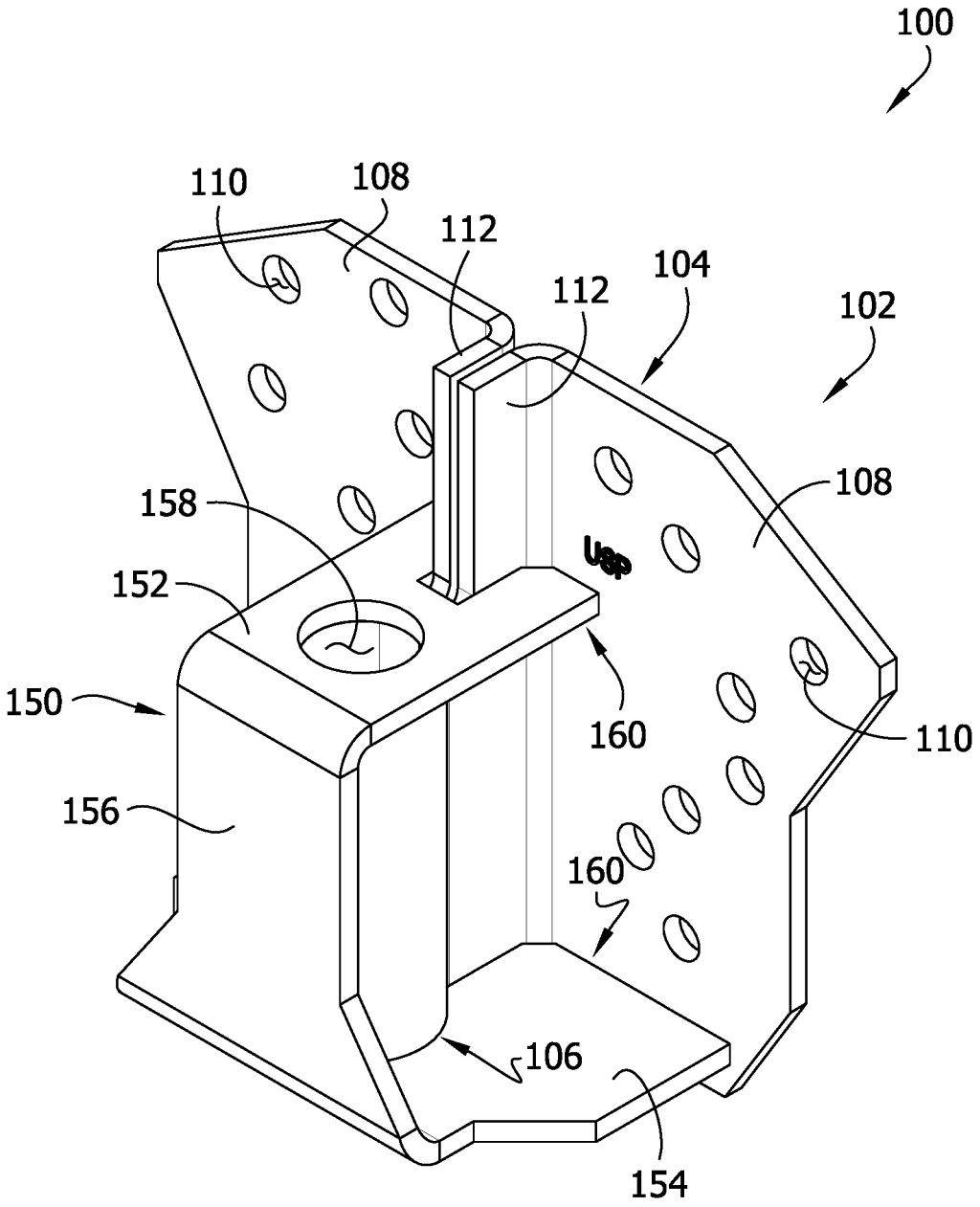
FIG. 2 is a perspective of a girder tie of the girder tiedown assembly.
Figure 3:
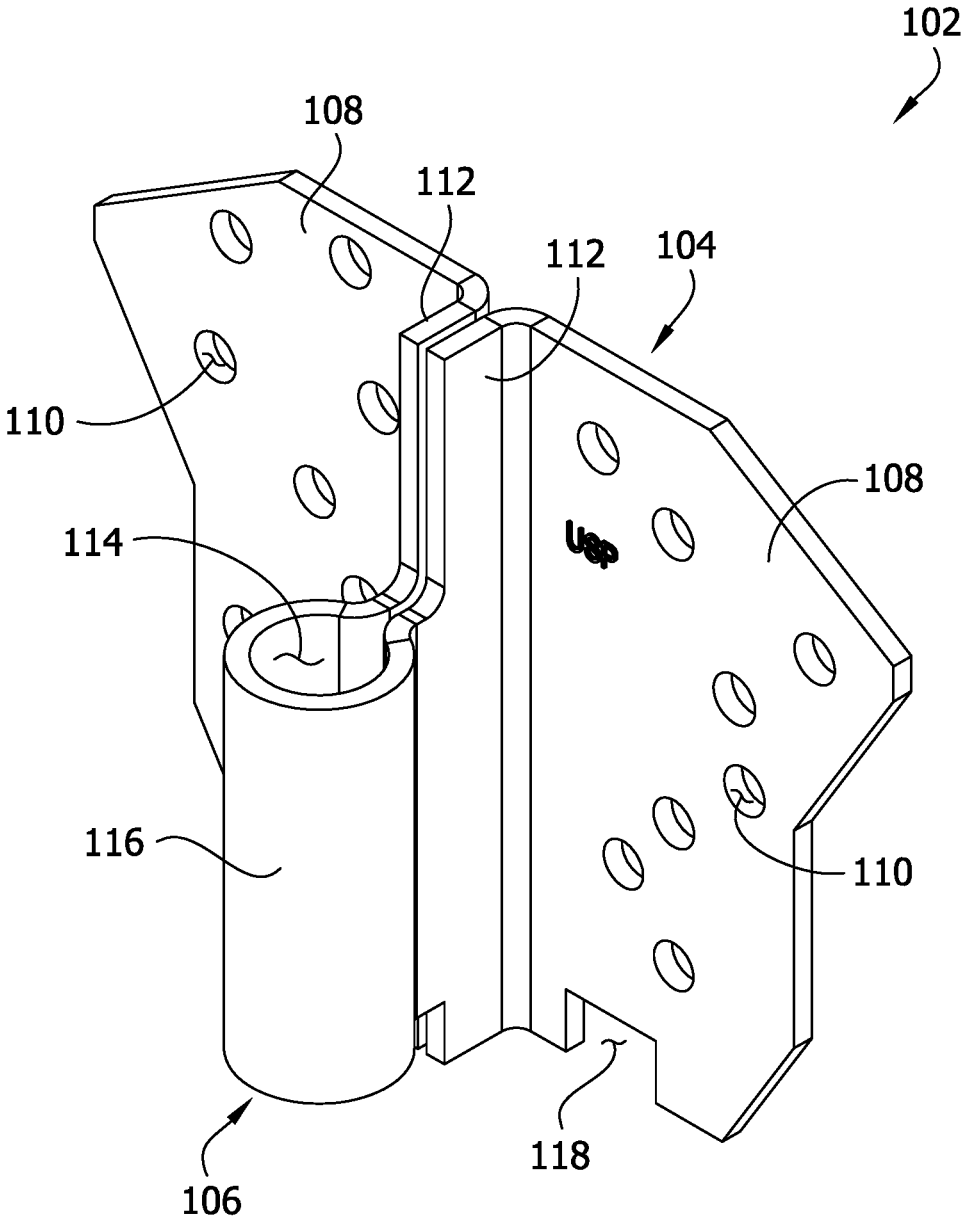
FIG. 3 is a perspective of a connector of the girder tie.
Figure 4:
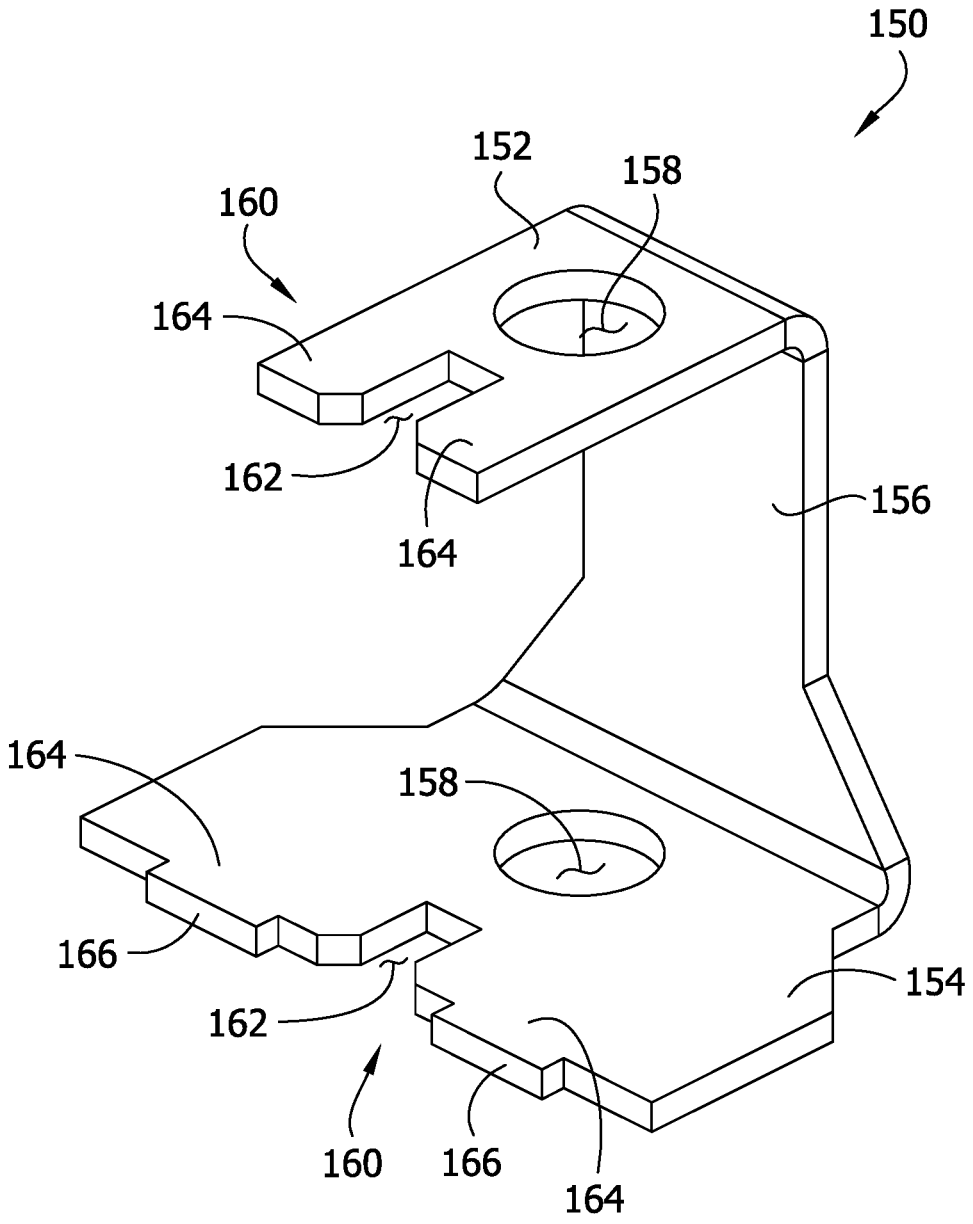
FIG. 4 is a back side perspective of a washer of the girder tie.

Referring to FIGS. 2-4, the girder tie 100 includes a connector 102 and a washer 150. The connector 102 is configured to be attached to the truss T and the rigid rod 14. The connector 102 includes a building component connector 104 and a rigid rod connector 106. The building component connector 104 and rigid rod connector 106 are coupled to one another and, more preferably, fixed to one another. The building component connector 104 is configured to attach to the truss T. The building component connector 104 includes first and second back flanges 108 (broadly, at least two back flanges). The first and second back flanges 108 are each configured to attach to the truss T. In one embodiment, the back flanges 108 are sized and shaped to attach to a 2×6 or larger piece of dimensioned lumber. In the illustrated embodiment, each back flange 108 includes a plurality of fastener holes 110 sized and shaped to receive fasteners 18 (FIG. 1), such as screws, bolts, nails, etc., to secure the back flanges and the building component connector 104 to the truss T. The first and second back flanges 108 are free of direct connection to one another. In one embodiment, the first and second back flanges 108 are spaced apart by about 1/16 inch (1.6 mm). However, the first and second back flanges 108 could be touching one another within the scope of the present invention. The first and second back flanges 108 are generally planar, with planar rear surfaces that engage the truss T when the building component connector 104 is secured to the truss T. The back flanges 108 can have generally any shape. Each back flange 108 may also include a notch or opening 118 configured to receive a portion of the washer 150, as described in more detail below. In the illustrated embodiment, each back flange 108 includes a notch 118 extending from a lower edge margin of the back flange.

The orientation of the girder tie 100 in FIG. 2 provides the point of reference for the terms defining relative locations and positions of structures and components of the girder tie, including but not limited to the terms "upper," "lower," "left," "right," "back," "rear," "front," as used throughout the present disclosure.

The connector 102 includes a flange or rib 112 extending forward from each back flange 108. In the illustrated embodiment, each rib 112 extends from an inner edge margin (e.g., the edge margin closest to the other back flange) of a corresponding back flange 108. Each rib 112 interconnects the back flanges 108 and the rigid rod connector 106. Accordingly, the ribs 112 extend from the back flange 108 to the rigid rod connector 106. The ribs 112 are generally vertical, when the connector 102 is secured to the truss T. The ribs 112 are generally perpendicular to the back flanges 108. In the illustrated embodiment, the ribs 112 generally extend along the entire height of the back flanges 108. The ribs 112 are adjacent to and generally parallel to one another for reasons that will become apparent. In one embodiment, a distance between the ribs 112 is less than or equal to 1/16 inch (1.6 mm). As described in more detail below, the ribs 112 facilitate the bracing of first and second back flanges 108 to inhibit the movement of the first and second back flanges relative to one another when the truss T experiences the uplift forces. The ribs 112 also generally stiffen and strengthen the back flanges 108.

The rigid rod connector 106 is configured to attach to the rigid rod 14. The rigid rod connector 106 defines a central passage 114 sized and shaped to receive the rigid rod 14. The rigid rod connector 106 includes a generally cylindrical wall or tube 116 that defines the central passage 114. The ribs 112 extend from the cylindrical wall 116. In the illustrated embodiment, the ribs 112 extend from opposite side edge margins of the generally cylindrical wall 116. Accordingly, in the illustrated embodiment, the cylindrical wall 116 is circumferentially discontinuous. As will become apparent, this discontinuity in the cylindrical wall 116 allows the connector 102 to be stamped from a single sheet of material, as described in more detail below. The rigid rod connector 106 has a height extending from a lower end to an upper end. In one embodiment, the height of the rigid rod connector 106 is about 2⅜ inches (6 cm). In one embodiment, the height of the rigid rod connector 106 is about half of the height of the back flanges 108. Other configurations of the rigid rod connector 106 are within the scope of the present disclosure.

The rigid rod connector 106 is configured to form a moment couple with the rigid rod 14 to resist the uplift forces applied to the truss T when the truss experiences the uplift forces. The rigid rod connector 106 is configured to engage the rigid rod 14 at a minimum of least two longitudinally spaced apart locations on the rigid rod when the truss T experiences the uplift forces to form the moment coupled with the rigid rod. Specifically, upper and lower ends of the rigid rod connector 106 engage the rigid rod 14 to form the moment couple as described in more detail below.

By forming a moment couple with the rigid rod 14, the girder tie 100 is able to resist larger uplift forces than conventional girder ties. Conventional girder ties do not form a moment couple with the rigid rod 14 because conventional girder ties engage the rigid rod at only one longitudinal location. In fact, some conventional girder ties permit the girder tie and rigid rod to pivot relative to one another, which completely prevents any moment couple from forming.

When the girder tie 100 is subjected to loads (e.g., uplift forces), the failure mode for the girder tie is being pulled from the truss T. Specifically, the fasteners 18 securing the girder tie 100 to the truss T are pulled out from (e.g., withdraw from) the truss when a sufficient amount of force is applied. When subject to uplift loads capable of causing failure, the nut 16 securing the rod 14 to the girder tie 100 is, in effect, driven down against the top of the cylindrical wall 116 of the rigid rod connector 106. The force applied to the rigid rod connector 106 is spaced from the back flanges 108 and therefore urges the girder tie 100 generally to pivot or rotate about its lowest most point (or thereabout) that engages the truss T. This movement tends to pry the fasteners 18 out from the truss T. The fasteners 18 resist this withdrawal movement, and the girder tie 100 is constructed to provide substantial additional resistance to pivoting and withdrawal. As the girder tie 100 begins to bend and pivot, the rigid rod connector 106 engages the rigid rod 14 at generally two spaced apart locations, one generally at the upper end of the rigid rod connector and another at the lower end of the rigid rod connector. This forms the moment couple between the rigid rod connector 106 and the rigid rod 14. Because of the moment couple, in order for the girder tie 100 to continue to pivot and move away from the truss T (e.g., in order for the girder tie to completely fail), the girder tie must bend the rigid rod 14. Accordingly, the resistance to bending provided by employing the stiffness of the rigid rod 14 increases the amount of the uplift force the girder tie 100 can support over conventional girder ties by reducing the withdrawal forces applied to the fasteners 18.

The loads applied during uplift can also have a tendency to separate the back flanges 108 from each other in a horizontal direction, which would apply a horizontal shear load to the fasteners 18, in addition to the vertical shear already being applied. However, the construction of the building component connector 104 inhibits this as well. The position of the force of the rigid rod 14 in relation to the location of the fasteners 18 extending through the back flanges 108 causes the back flanges to move apart. Additionally, the force of the rigid rod 14 against the interior of the cylindrical wall 116 of the rigid rod connector 106 because of the moment couple, also acts to force the back flanges apart. However, referring to FIGS. 2 and 4, the washer 150 is configured to be disposed between the rigid rod connector 106 of the connector 102 and the nut 16 on the rigid rod 14 that secures the rigid rod to the girder tie 100. The washer 150 serves two functions. First, the washer 150 generally distributes the load applied by the nut 16 over the rigid rod connector 106, like a conventional washer. Second, the washer 150 captures the ribs 112 to inhibit or prevent the first and second back flanges 108 from moving horizontally apart from each other when the truss T experiences the uplift forces, as described in more detail below.

As shown in FIG. 4, the washer 150 includes an upper flange 152, a lower flange 154 and a connecting element 156. The connecting element 156 interconnects the upper and lower flanges 152, 154. The upper flange 152, lower flange 154 and connecting element 156 are all generally planar. The upper and lower flanges 152, 154 are generally parallel with one another and extend rearward from upper and lower edge margins, respectively, of the connecting element 156 to free ends thereof. The upper and lower flanges 152, 154 are generally perpendicular to the connecting element 156. The upper and lower flanges 152, 154 each define an aperture or opening 158 sized and shaped to receive the rigid rod 14 through the flange. The openings 158 are aligned (e.g., vertically aligned) with one another and are configured to align with the central passage 114 of the rigid rod connector 106 when the washer is positioned on the rigid rod connector 106. Accordingly, the upper flange 152 is disposed between the nut 16 and the rigid rod connector 106 when the washer 150 and connector 102 are attached to the rigid rod 14.

The washer 150 includes a back flange brace, generally indicated at 160, configured to brace the ribs 112 to inhibit the first and second back flanges 108 from moving relative to one another when the truss T experiences the uplift forces. Specifically, the back flange brace 160 inhibits the first and second back flanges 108 from rotating relative to one another, as explained in more detail below. In the illustrated embodiment, the washer includes two back flange braces 160 (e.g., upper and lower back flange braces). Each back flange brace 160 is configured to engage the ribs 112 to prevent the ribs, and therefore the back flanges 108, from moving apart from one another. Specifically, each back flange brace 160 is configured to inhibit the ribs 112 from moving away from one another (e.g., inhibit the back flanges 108 from moving away from one another). In the illustrated embodiment, the upper and lower flanges 152, 154 each define one back flange brace 160. Each back flange brace 160 includes an open ended slot 162 (e.g., a slot extending from an edge margin of the upper or lower flange 152, 154). The slots 162 are sized and shaped to receive the ribs 112 therein. Accordingly, the slots 162 are generally aligned (e.g., vertically aligned) with one another. Opposite sides of each slot 162 are defined by bracing tabs 164 (e.g., portions of either the upper or lower flanges 152, 154). Each bracing tab 164 engages a respective one of the ribs 112 when the ribs are disposed in the slot 162 to prevent the back flanges 108 from moving horizontally apart.

In the illustrated embodiment, each bracing tab 164 on the lower back flange brace 160 includes a projection 166 sized and shaped to mate with one of the notches 118 of a corresponding back flange 108. The projections 166 extend rearward from a rear edge margin of the lower flange 154. The mating of the projections 166 with the notches 118 facilitates the positioning of the washer 150 relative to the connector 102, and further prevents the back flanges 108 from moving (e.g., toward or away) relative to one another and helps hold the washer in place relative to the connector when the girder tie 100 is subject to the uplift forces.

In operation, the washer 150 is placed on the connector 102 such that the openings 158 of the washer are aligned with the central passage 114 of the connector. In this position, the upper flange 152 of the washer 150 overlies the upper end of the rigid rod connector 106 and the lower flange 154 lies under the lower end of the rigid rod connector. Accordingly, the distance between the upper and lower flanges 152, 154 is generally the same as the height of the rigid rod connector 106. When the washer 150 is positioned on the connector 102, the projections 166 are inserted into the corresponding notches 118. This facilitates the alignment of the openings 158 and central passage 114. Moreover, when the washer 150 is positioned on the connector 102, the ribs 112 are captured in the slots 162. The washer 150 may be placed on the connector 102 before or after the connector is secured to the truss T with the fasteners 18. Once positioned, the rigid rod 14 can be inserted into and extend through the openings 158 and central passage 114. The nut 16 is then threaded onto the end of the rigid rod 14 until the nut engages the washer 150, thereby securing the girder tie 100 to the rigid rod. Preferably, the girder tie 100 is secured to the truss T before the nut 16 is tightened down against the washer 150.

When the girder tie 100 is subject to the uplift forces, the first and second back flanges 108 are urged to move relative to one another (e.g., generally away from one another). Specifically, the first and second back flanges want to generally pivot and rotate relative to one another. This movement of the back flanges 108 is caused, at least in part, by the moment couple formed between the rigid rod connector 106 and the rigid rod 14 in conjunction with the force of the rigid rod being offset from the location of the resisting force provided by the fastener 18. Below the point of level of the engagement of the nut 16 with the washer 150 at the top of the rigid rod connector 106, the bottoms of the back flanges 108 are urged to pivot away from each other about a separation axis perpendicular to the back flanges and passing through the center of engagement of the nut with the washer at the top of the rigid rod connector. The back flange braces 160 inhibit this movement (e.g., lateral and/or rotational movement about the longitudinal axis of the rigid rod connector 106) of the back flanges 108. As the back flanges 108 try to move away from one another due to the uplift forces, the bracing tabs 164 of the back flange braces 160 engage the ribs 112, preventing the ribs and therefore the back flanges from moving apart and causing the back flanges 108 to act as a single piece of material. Moreover, because the back flange braces 160 restrict the movement (e.g., generally horizontal movement) of the back flanges 108, any load (e.g., horizontal load) that would have been imposed on the fasteners 18 because of the movement of the back flanges is eliminated (e.g., all this horizontal load is contained and carried by the back flange braces). This eliminates placing any additional load on the fasteners 18 and generally keeps the load on the fasteners to generally only vertical shear and withdrawal. It is understood that by subjecting the fasteners 18 to less load (e.g., the horizontal load), the fasteners can carry or withstand a large amount of vertical shear load and withdrawal load. Thus, the back flange braces 160 help strengthen the connection of the building component connector 104 to the truss T. In addition, because the back flanges 108 pivot relative to another, a portion of the back flanges above the separation axis may move toward one another as the back flanges pivot. As a result, portions of the ribs 112 are brought into engagement with and push against one another, cancelling out a portion of the load (e.g., horizontal load).

Figure 5:
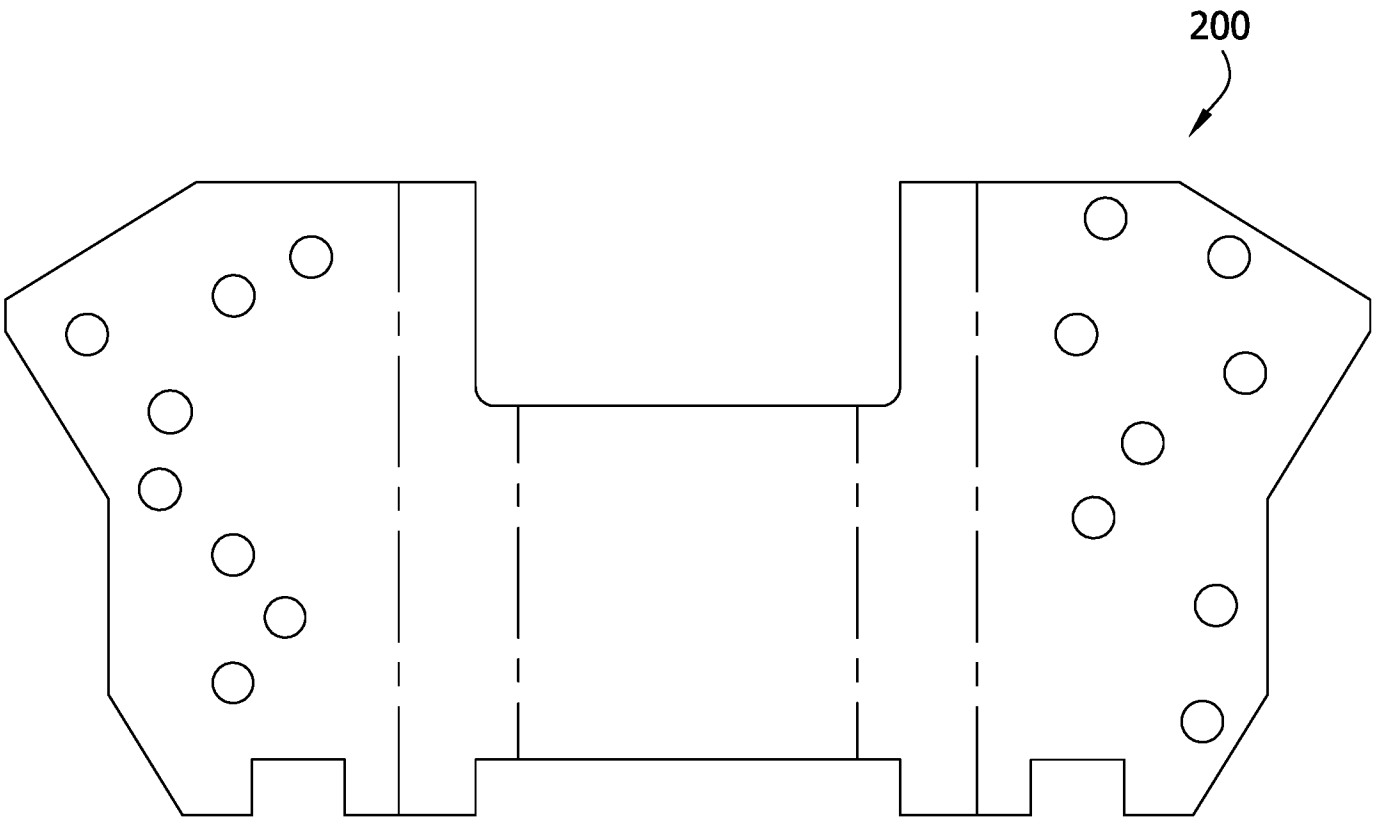
FIG. 5 is a top view of a connector blank for forming the connector.
Figure 6:
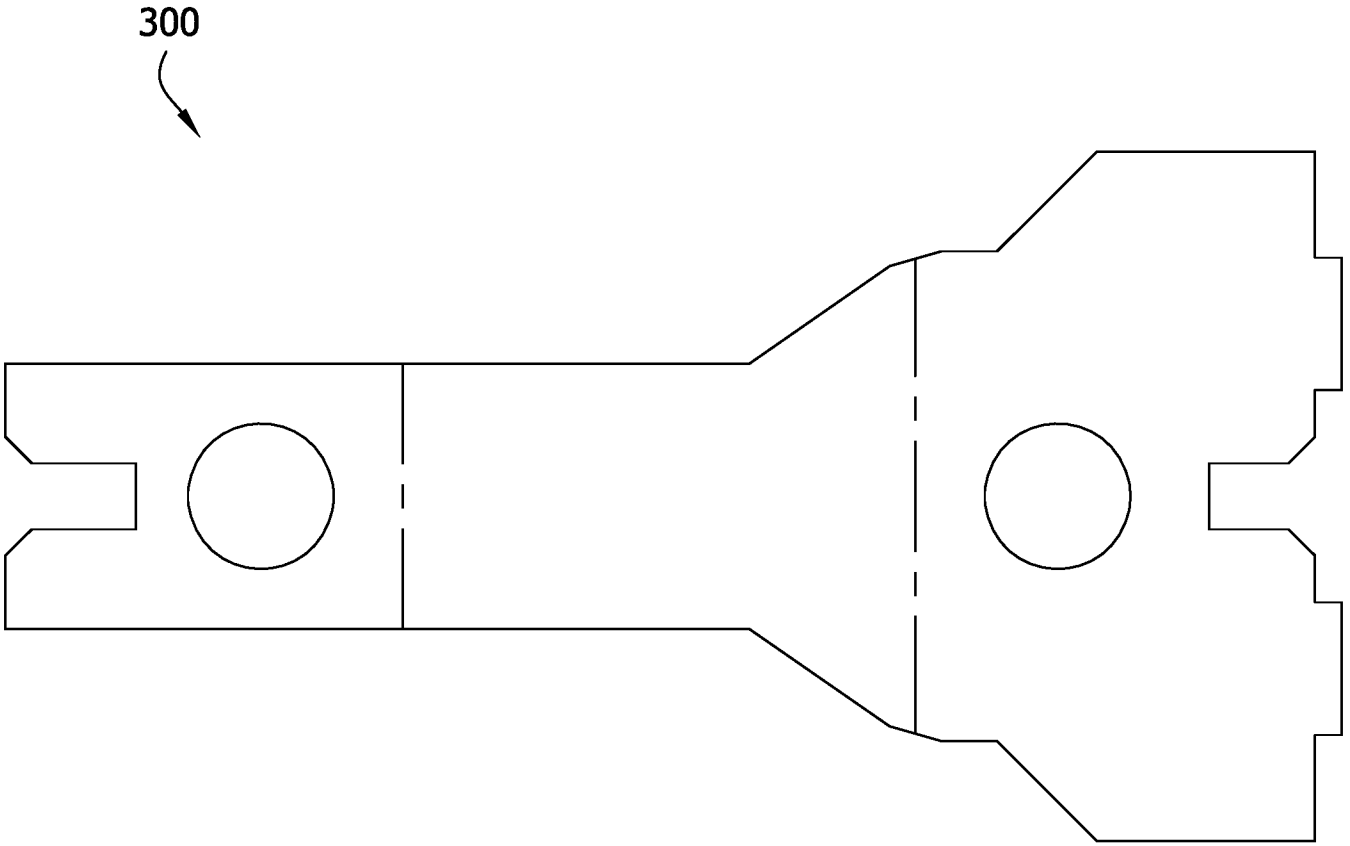
FIG. 6 is a top view of a washer blank for forming the washer.

The connector 102 and washer 150 are preferably made from metal. In one embodiment, the connector 102 and washer 150 are each formed as one piece (e.g., the connector and washer are each integral one-piece components) from metal blanks 200 and 300, respectively, (FIGS. 5 and 6) that are stamped from a sheet of material (e.g., metal) and bent into shape. As a result, the first and second back flanges 108 are indirectly connected to each other by way of the rigid rod connector 106. However, there is no direct connection between the first and second back flanges in the plane of the first and second back flanges. A direct connection could be made between the first and second back flanges 108 in their common plane, but is not necessary because of the functionality of the washer 150. In one embodiment, the connector 102 and washer 150 are each stamped from 10 gauge steel, although other suitable materials are within the scope of the present disclosure. In other embodiments, the connector 102 and the washer 150 are made from multiple pieces joined together, such as by welding.

Figure 7:
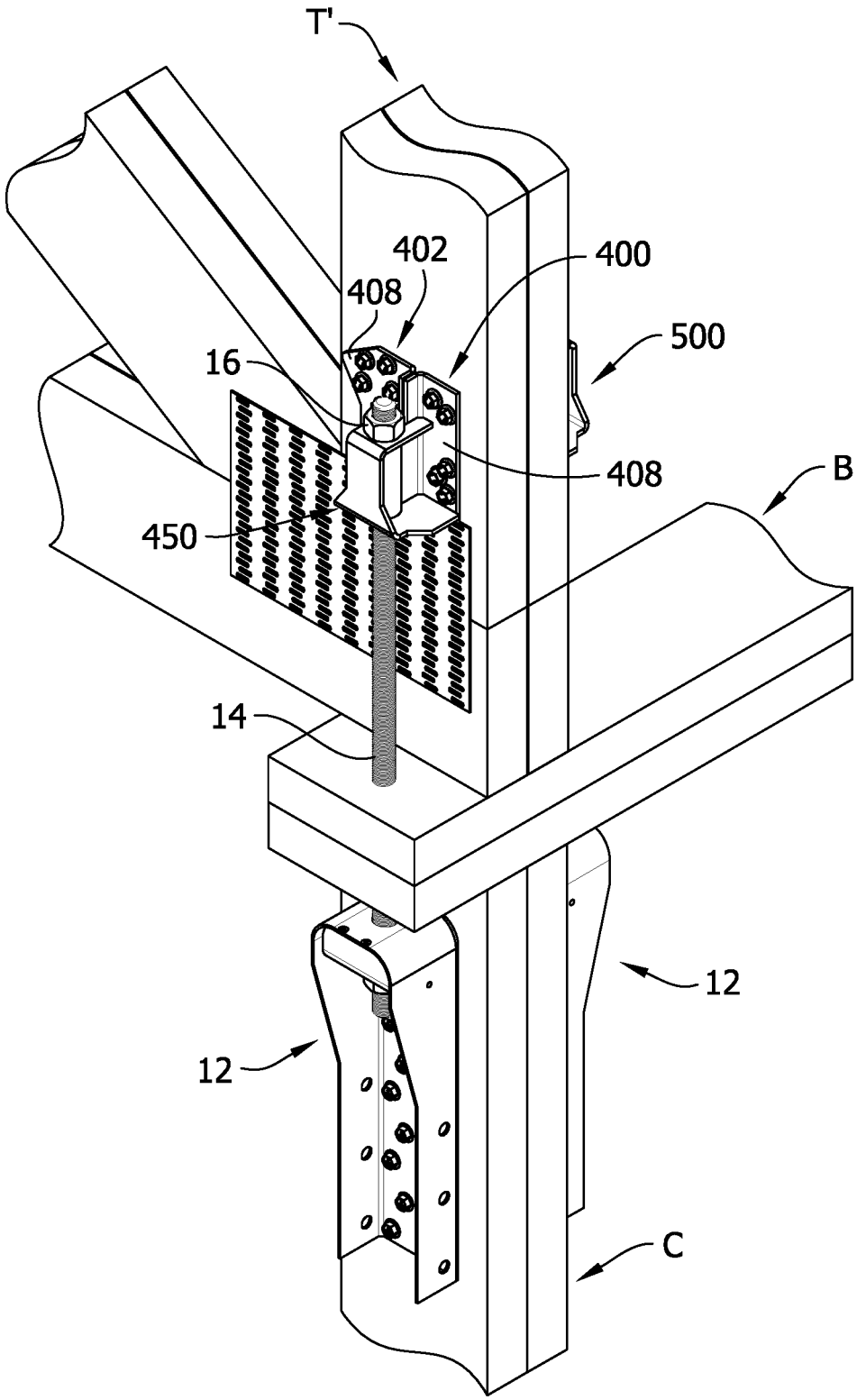
FIG. 7 is a front perspective of a fragmentary portion of a building showing a first girder tiedown assembly according to another embodiment of the present disclosure tying a truss of the building to a column or stud(s) of the building.

Referring to FIG. 7, another embodiment of a girder tie according to the present disclosure is generally indicated by reference numeral 400. Girder tie 400 is generally analogous to girder tie 100 and, thus, for ease of comprehension, where similar, analogous or identical parts are used, reference numerals "300" units higher are employed. Accordingly, unless clearly stated or indicated otherwise, the above descriptions regarding girder tie 100 also apply to girder tie 400.

The girder tie 400 is a first or left oriented girder tie configured to be attached to the left side of a building component, such as a truss T' or a column. In this embodiment, the right or second back flange 408 has a straight outer edge margin. As a result, the width of the right back flange 408 is reduced (compared to back flange 108), thereby reducing the overall width of the connector 402 (e.g., building component connector 404). The back flanges 408 of the girder tie 400 have different shapes. The straight edge of the second back flange 408 allows the connector 402 to be attached to smaller building elements, such as 2×4 piece of dimensioned lumber.

Figure 8:
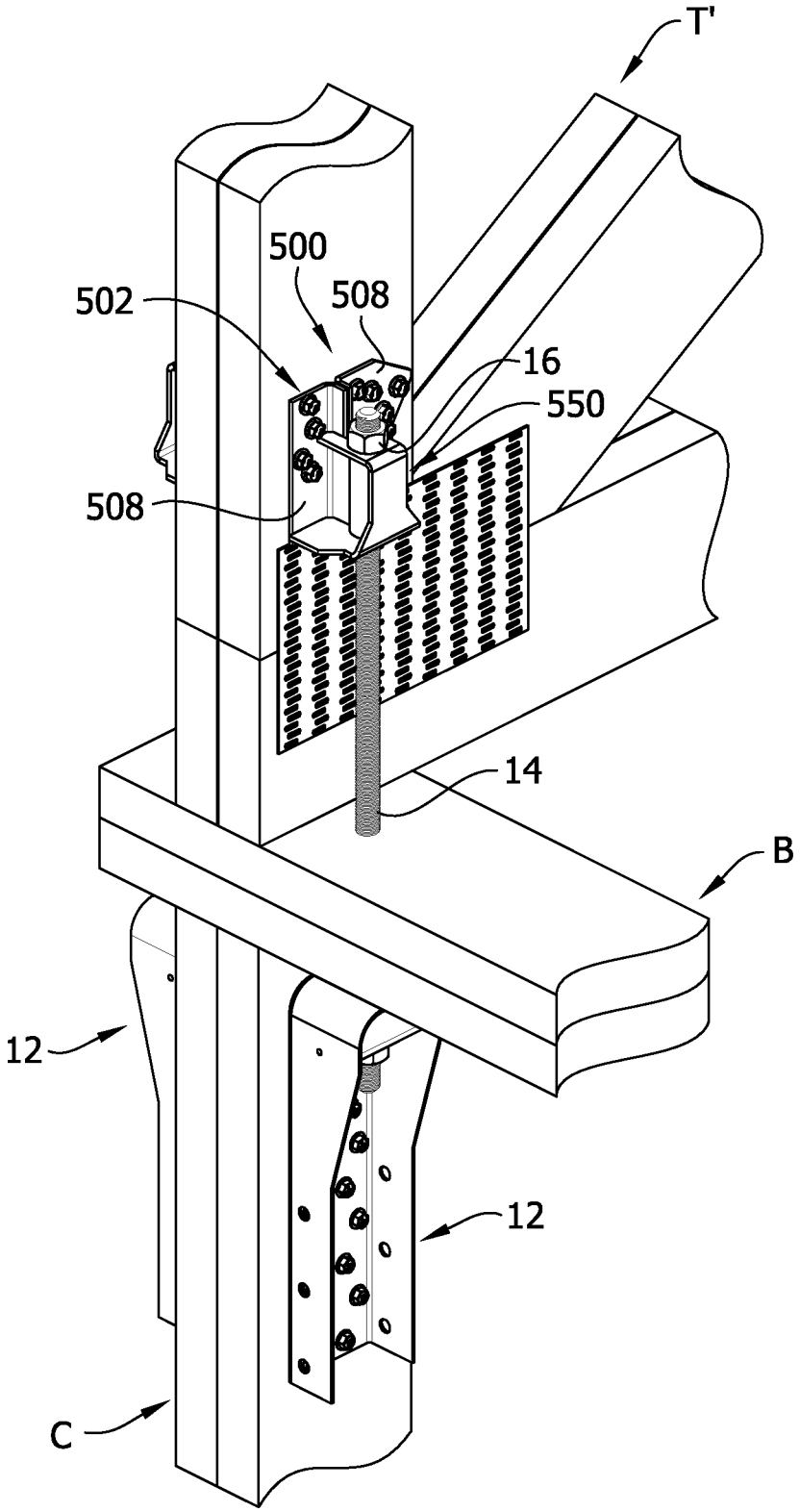
FIG. 8 is a rear perspective the fragmentary portion of the building shown in FIG. 7 showing a second girder tiedown assembly according to another embodiment of the present disclosure tying the truss to the column or stud(s)
Figure 9:
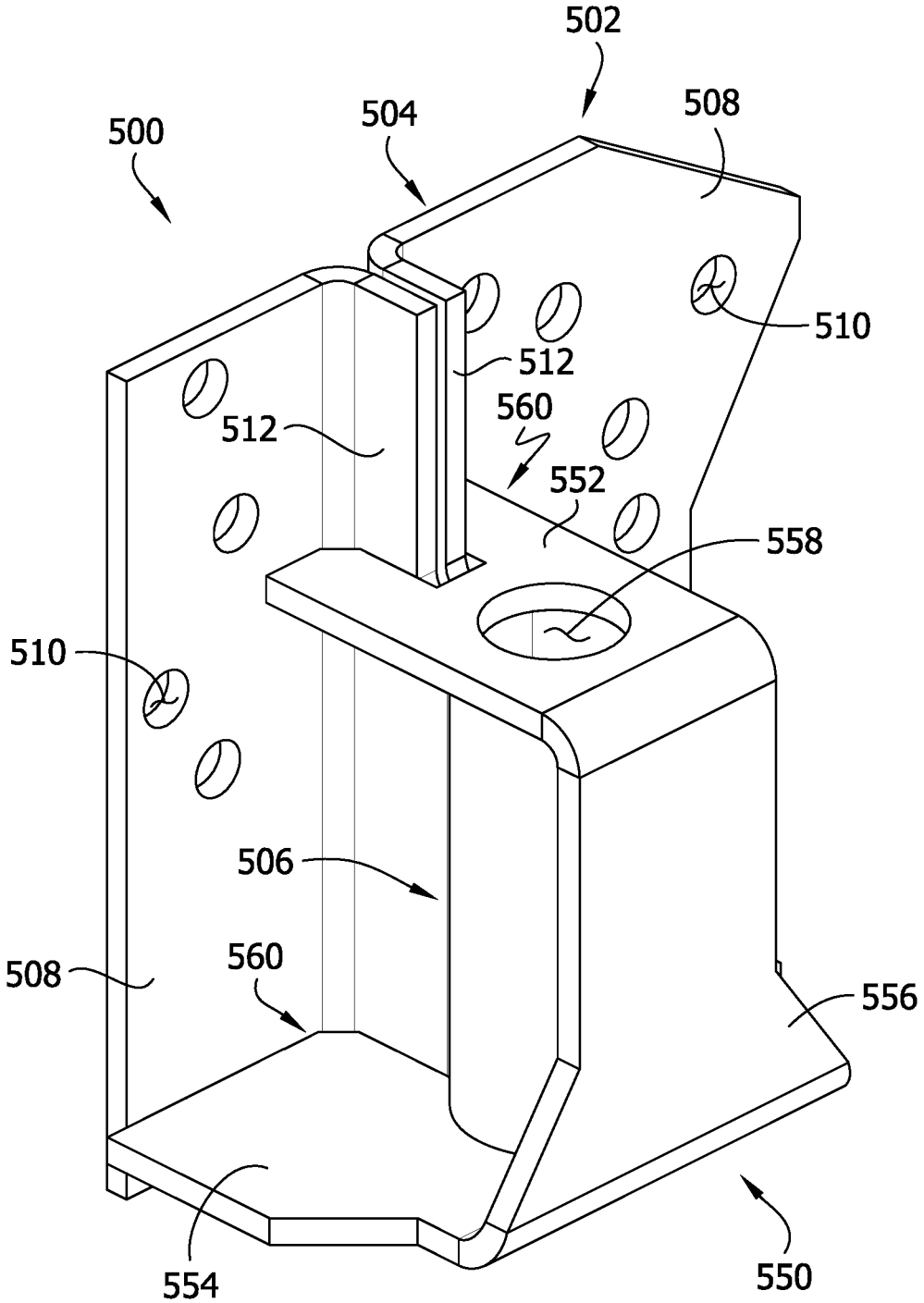
FIG. 9 is a perspective of a girder tie of the second girder tiedown assembly.

Referring to FIGS. 8 and 9, another embodiment of a girder tie according to the present disclosure is generally indicated by reference numeral 500. Girder tie 500 is generally analogous to girder tie 100 and, thus, for ease of comprehension, where similar, analogous or identical parts are used, reference numerals "400" units higher are employed. Accordingly, unless clearly stated or indicated otherwise, the above descriptions regarding girder tie 100 also apply to girder tie 500.

The girder tie 500 is a second or right oriented girder tie configured to be attached to the left side of a building component, such as a truss T' or a column. In this embodiment, the left or first back flange 508 has a straight outer edge margin. As a result, the width of the left back flange 508 is reduced (compared to back flange 108), thereby reducing the overall width of the connector 502 (e.g., building component connector 504). This allows the connector 502 to be attached to smaller building elements, such as 2×4 piece of dimensioned lumber. FIGS. 7 and 8 illustrate the left oriented girder tie 400 attached to the left side of the truss T' and the right oriented girder tie 500 attached to the right side of the truss T'.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A girder tie for connecting a building component to a rigid rod to resist uplift forces applied to the building component, the girder tie comprising:

a connector including a building component connector configured to attach to the building component and a rigid rod connector joined with the building component connector and configured to attach to the rigid rod, the rigid rod connector configured to form a moment couple with the rigid rod to resist the uplift forces applied to the building component when the building component experiences the uplift forces; and a first nut configured to be threaded onto the rigid rod into engagement with the rigid rod connector to secure the rigid rod to the girder tie, and a second nut configured to be threaded onto the rigid rod at a location spaced from the first nut to cooperate with the first nut and rigid rod connector to block upward movement of the building component connector on the rigid rod.

2. The girder tie of claim 1, wherein the rigid rod connector is configured to engage the rigid rod at least at two longitudinally spaced apart locations on the rigid rod when the building component experiences the uplift forces to form the moment couple with the rigid rod.

3. The girder tie of claim 2, wherein the rigid rod connector includes a generally cylindrical tube defining a passage sized and shaped to receive the rigid rod.

4. The girder tie of claim 3, further comprising a washer configured to be disposed between the rigid rod connector and the first nut.

5. The girder tie of claim 4, wherein the building component connector includes first and second back flanges free of direct connection to one another, the first and second back flanges each configured to attach to the building component.

6. The girder tie of claim 5, wherein the washer includes a back flange brace configured to inhibit the first and second back flanges from moving relative to one another when the building component experiences the uplift forces.

7. The girder tie of claim 6, wherein the back flange brace inhibits the first and second back flanges from rotating relative to one another.

8. The girder tie of claim 6, wherein the building component connector includes a first rib interconnecting the first back flange and the rigid rod connector and a second rib interconnecting the second back flange and the rigid rod connector, the back flange brace configured to engage the first and second ribs to inhibit the first and second back flanges from moving relative to one another.

9. The girder tie of claim 1, further comprising the rigid rod.

10. The girder tie of claim 9, further comprising a holdown configured to attach to the rigid rod.

11. A girder tie for connecting a building component to a rigid rod to resist uplift forces applied to the building component, the girder tie comprising:

a connector including a building component connector configured to attach to the building component and a rigid rod connector joined with the building component connector and configured to attach to the rigid rod, the rigid rod connector being configured to engage the rigid rod at least at two spaced apart locations on the rigid rod to form a moment couple with the rigid rod to resist the uplift forces applied to the building component when the building component experiences the uplift forces, wherein the rigid rod connector includes a generally cylindrical tube defining a passage sized and shaped to receive the rigid rod, and wherein the building component connector includes first and second back flanges free of direct connection to one another, the first and second back flanges each being configured to attach to the building component;

a nut configured to be threaded onto the rigid rod into engagement with the rigid rod connector to secure the rigid rod to the girder tie; and a washer configured to be disposed between the rigid rod connector and the nut, the washer including a back flange brace configured to inhibit the first and second back flanges from moving relative to one another when the building component experiences the uplift forces.

12. The girder tie of claim 11, wherein the back flange brace inhibits the first and second back flanges from rotating relative to one another.

13. The girder tie of claim 11, wherein the building component connector includes a first rib interconnecting the first back flange and the rigid rod connector and a second rib interconnecting the second back flange and the rigid rod connector, the back flange brace configured to engage the first and second ribs to inhibit the first and second back flanges from moving relative to one another.

* * * * *